US006655030B2

(12) United States Patent
Zuidervaart

(10) Patent No.: US 6,655,030 B2
(45) Date of Patent: Dec. 2, 2003

(54) SHAVING HEAD AND SHAVER PROVIDED WITH SUCH A SHAVING HEAD

(75) Inventor: Jasper Zuidervaart, Drachten (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 36 days.

(21) Appl. No.: 10/023,067

(22) Filed: Dec. 18, 2001

(65) Prior Publication Data

US 2002/0088122 A1 Jul. 11, 2002

(30) Foreign Application Priority Data

Dec. 22, 2000 (EP) ..... 00204791

(51) Int. Cl.[7] ..... B26B 21/22
(52) U.S. Cl. ..... 30/50; 30/346.5; 30/346.57
(58) Field of Search ..... 30/50, 346.57, 30/346.5

(56) References Cited

U.S. PATENT DOCUMENTS 2,817,146 A * 12/1957 Roberts ..... 30/50
3,842,499 A * 10/1974 Dorion et al. ..... 30/50
3,861,040 A * 1/1975 Dorion, Jr. ..... 30/50
3,863,340 A * 2/1975 Perry ..... 30/50
3,938,250 A * 2/1976 Perry ..... 30/346.57
4,562,644 A 1/1986 Hitchens ..... 30/41
6,212,777 B1 * 4/2001 Gilder et al. ..... 30/50
6,266,884 B1 * 7/2001 Prochaska ..... 30/346.57
2002/0035786 A1 * 3/2002 Gilder et al. ..... 30/50

* cited by examiner

*Primary Examiner*—Stephen Choi
(74) *Attorney, Agent, or Firm*—Ernestine C. Bartlett

(57) ABSTRACT

The invention relates to a shaving head (1) having at least two cutting members, the cutting edge (7)of at least one of the cutting members (5) being situated at a side, remote from the other cutting member (9), of an imaginary center plane (41) of the carrier (31) of the relevant cutting member, and having a tip angle ($\alpha_1$)enclosed by a main side face (37) and a facet surface (43) of the carrier (31). In this manner, the cutting edge of the relevant cutting member has a tip angle ($\alpha_1$) which is asymmetrical relative to the center plane of the carrier. As a result, a space (57), which is present between the carriers (31, 33) of the two cutting members, is divergent, viewed from the skin contact surface (29), and the risk of said space becoming clogged by cut hairs and shaving foam is considerably reduced.

5 Claims, 3 Drawing Sheets

SHAVING HEAD AND SHAVER PROVIDED WITH SUCH A SHAVING HEAD

BACKGROUND OF THE INVENTION

The invention relates to a shaving head comprising at least a first cutting member and a second cutting member which, viewed in a shaving direction of the shaving head, is arranged behind the first cutting member, said cutting members each comprising a plate-shaped carrier provided with a substantially straight cutting edge extending substantially in a skin contact surface with which, in operation, the shaving head bears against the skin to be shaved, and a cutting angle present between the second cutting member and the skin contact surface being equal to or larger than a cutting angle present between the first cutting member and the skin contact surface.

The invention also relates to a shaver comprising a handgrip and a shaving head secured to said handgrip, which shaving head is provided with at least a first cutting member and a second cutting member which, viewed in a shaving direction of the shaving head, is arranged behind the first cutting member, the cutting members each comprising a plate-shaped carrier provided with a substantially straight cutting edge extending substantially in a skin contact surface with which, in operation, the shaving head bears against the skin to be shaved, and a cutting angle present between the second cutting member and the skin contact surface being equal to or larger than a cutting angle present between the first cutting member and the skin contact surface.

A shaving head and a shaver of the types mentioned in the opening paragraphs are generally known and commonly used, particularly, respectively, in and as a razor. In a known shaving head, the plate-shaped carriers of the cutting members are arranged so as to be substantially parallel in a holder. The two main side faces of each of the carriers are sharpened substantially symmetrically, so that the cutting edges of the cutting members each have a tip angle which is substantially symmetrical with respect to a center plane of the carrier extending between the two main side faces of the carrier of the relevant cutting member. Thus, in the known shaving head, a substantially equal cutting angle is present between each cutting member and the skin contact surface, which cutting angle is defined as the acute angle enclosed between the skin contact surface and a bisector of the tip angle of the cutting edge of the relevant cutting member. A drawback of the known shaving head resides in that cut hairs and shaving foam collect in the comparatively narrow interspace between the parallel carriers of the cutting members. As a result, said interspace becomes clogged with the passage of time, causing the shaving performance of the known shaving head to be reduced substantially.

The above-mentioned drawback occurs to a larger extent in a shaving head disclosed in U.S. Pat. No. 4,562,644. In this known shaving head, the cutting angle between the skin contact surface and the second cutting member which, viewed in the shaving direction, is arranged behind the first cutting member, is larger than the cutting angle between the skin contact surface and the first cutting member. As a result, the skin smoothness that can be achieved using this known shaving head is comparatively high, and also the shaving comfort is comparatively high. This can be attributed to the fact that in the case of cutting members as applied in the known shaving head, the skin smoothness that can be achieved increases as the cutting angle between the cutting member and the skin contact surface increases. However, the shaving comfort decreases as the cutting angle increases, which can be attributed to the fact that the tensile forces exerted on the hairs increase. In the case of the shaving head known from U.S. Pat. No. 4,562,644, the hairs are first cut by the first cutting member. This cutting member has a comparatively small cutting angle as a result of which the hairs are shortened in a comparatively comfortable way. Subsequently, the hairs shortened by the first cutting member are shortened further by the second cutting member having a larger cutting angle, as a result of which a comparatively high skin smoothness is attained, which is characteristic of this larger cutting angle. The cutting of already shortened hairs by means of a cutting member having a comparatively large cutting angle is experienced by the user as much less painful, however, than the cutting of comparatively long hairs by means of such a cutting member, so that the known shaving head is experienced as comfortable by the user in spite of the comparatively large cutting angle of the second cutting member. As the cutting angle of the second cutting member is larger than the cutting angle of the first cutting member, an interspace is present, however, between the carriers of the two cutting members of this known shaving head, which interspace converges, viewed from the skin contact surface. As a result, in operation, cut hairs and shaving foam cause this interspace to become clogged comparatively rapidly.

OBJECTS AND SUMMARY OF THE INVENTION

It is an object of the invention to provide a shaving head and a shaver of the types mentioned in the opening paragraphs, wherein a cutting angle is present between the second cutting member and the skin contact surface, which cutting angle, like in the known shaving heads, is equal to or larger than the cutting angle present between the first cutting member and the skin contact surface, and wherein, however, the above-mentioned drawback of the known shaving heads is reduced as much as possible.

To achieve this object, a shaving head in accordance with the invention is characterized in that the cutting edge of at least one of the two cutting members is situated on a side, facing away from the other cutting member, of an imaginary center plane of the carrier of the relevant cutting member, said imaginary center plane extending between the two main side faces of the carrier.

To achieve this object, a shaver in accordance with the invention is characterized in that the shaving head used therein is a shaving head in accordance with the invention.

As the cutting edge of at least one of the two cutting members is situated on said side of the imaginary center plane, i.e. outside the imaginary center plane of the carrier of the relevant cutting member, the cutting edge of the relevant cutting member has a tip angle which is asymmetrical with respect to said center plane, so that the bisector of said tip angle encloses an angle with said center plane. As a result, the cutting angle of the relevant cutting member, which is determined by the acute angle enclosed between the skin contact surface and said bisector, differs from the acute angle enclosed between the skin contact surface and said center plane. As the cutting edge of the relevant cutting member is situated on the side of said center plane facing away from the other cutting member, it is achieved in an embodiment wherein the cutting angles of the two cutting members are equal, to provide an interspace between the carriers of the two cutting members which, viewed from the skin contact surface, is divergent. Said interspace has a divergence angle which is substantially equal to the angle between said bisector and said center plane. The risk of such a divergent interspace becoming clogged is much smaller than the risk of an interspace between two parallel carriers becoming clogged, as in the case of the above-mentioned known shaving head having cutting members with equal cutting angles. In an embodiment wherein the second cutting member has a larger cutting angle than the first cutting member, an interspace between the carriers of the cutting members is provided, as a result of said position of the cutting edge of at least one of the cutting members, which interspace, viewed from the skin contact surface, is less convergent or even divergent as compared to the above-mentioned shaving head known from U.S. Pat. No. 4,562,644. The risk of such a less convergent, or even divergent, interspace becoming clogged is much smaller than the risk of an interspace between two more convergent carriers becoming clogged, as in the case of the shaving head known from U.S. Pat. No. 4,562,644.

A particular embodiment of a shaving head in accordance with the invention is characterized in that the cutting edge of the relevant cutting member has a tip angle which is predominantly enclosed by a main side face, facing away from the other cutting member, of the carrier of the relevant cutting member and by a facet surface provided on a main side face, facing the other cutting members, of said carrier. In this particular embodiment, the cutting edge is provided on the relevant cutting member by providing a facet surface on only one side of the carrier. As a result, the cutting edge has a chisel-shaped tip angle. In this manner, the angle enclosed between the bisector of the tip angle and the imaginary center plane of the carrier is as large as possible. As a result, in an embodiment comprising cutting members having equal cutting angles, the interspace between the carriers of the cutting members has an even larger divergence angle or, in an embodiment wherein the second cutting member has a larger cutting angle than the first cutting member, an even less convergent, or even more divergent interspace between the carriers of the cutting members is provided.

A further embodiment of a shaving head in accordance with the invention is characterized in that the shaving head is provided with only two cutting members, the cutting edge of the first cutting member being situated on a side, facing away from the second cutting member, of the imaginary center plane of the carrier of the first cutting member, while the cutting edge of the second cutting member is situated on a side, facing away from the first cutting member, of the imaginary center plane of the carrier of the second cutting member. As the cutting edges of the cutting members are in said positions relative to the imaginary center planes of the carriers, the divergence angle of the interspace between the carriers is further increased in an embodiment comprising cutting members with equal cutting angles, or, in an embodiment where the second cutting member has a larger cutting angle than the first cutting member, an even less convergent, or even more divergent interspace between the carriers of the cutting members is obtained.

A still further embodiment of a shaving head in accordance with the invention is characterized in that the shaving head is provided with a third cutting member which, viewed in the shaving direction, is arranged behind the first and the second cutting member, a cutting angle present between the third cutting member and the skin contact surface being equal to or larger than a cutting angle present between the second cutting member and the skin contact surface, and the cutting edge of the second cutting member being situated substantially in the imaginary center plane of the carrier of the second cutting member, the cutting edge of the first cutting member, however, being situated on a side, facing away from the second cutting member, of the imaginary center plane of the carrier of the first cutting member, and the cutting edge of the third cutting member being situated on a side, facing away from the second cutting member, of the imaginary center plane of the carrier of the third cutting member. As a result, in an embodiment comprising three cutting members having equal cutting angles, an interspace is provided between the carriers of the first and the second cutting member as well as between the carriers of the second and the third cutting member, which interspace is divergent, viewed from the skin contact surface. In an embodiment wherein the cutting angle of the second cutting member is larger than the cutting angle of the first cutting member, and wherein the cutting angle of the third cutting member is larger than the cutting angle of the second cutting member, an interspace is provided between the carriers of the first and the second cutting member as well as between the carriers of the second and the third cutting member, which interspace, viewed from the skin contact surface, has a comparatively small convergence, or even exhibits a divergence.

BRIEF DESCRIPTION OF THE DRAWING

Embodiments of a shaving head and a shaver in accordance with the invention will be described in greater detail hereinafter and partly shown in the drawings, wherein FIG. 1 diagrammatically shows a shaver in accordance with the invention, which is provided with a first embodiment of a shaving head in accordance with the invention.

DESCRIPTION OF THE PREFERRED EMBODIMENTS

Figure 1:
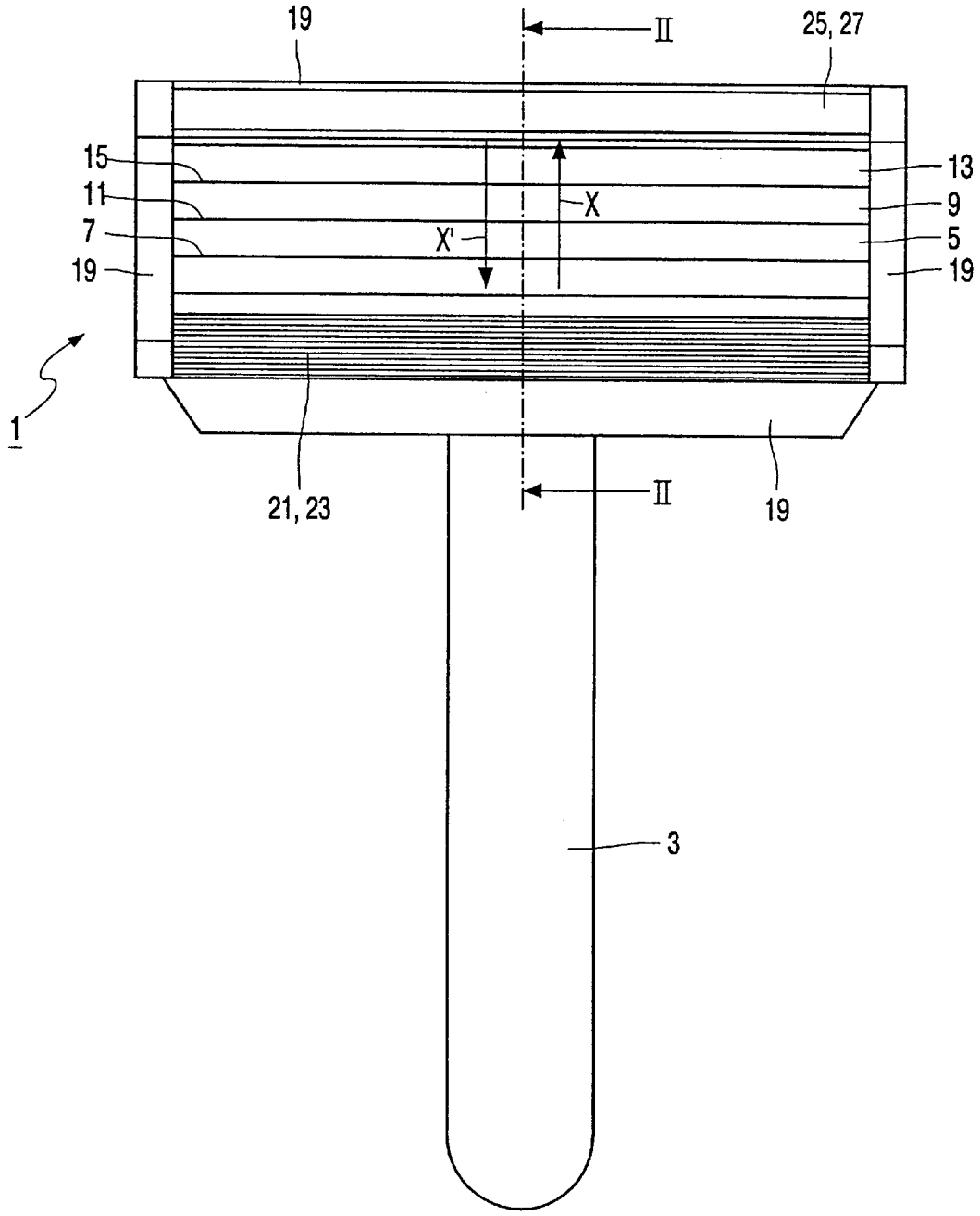

FIG. 1 diagrammatically shows a shaver in accordance with the invention, the shaver in the example shown being a razor. The shaver is provided with a first embodiment of a shaving head 1 in accordance with the invention, which, in the example of the shaver shown, is detachably attached to a handgrip 3 of the shaver by means of a coupling mechanism, which is not shown in the drawing. It is to be noted, however, that the invention also comprises embodiments of a shaver wherein the shaving head is not detachably attached to the handgrip.

Figure 2:
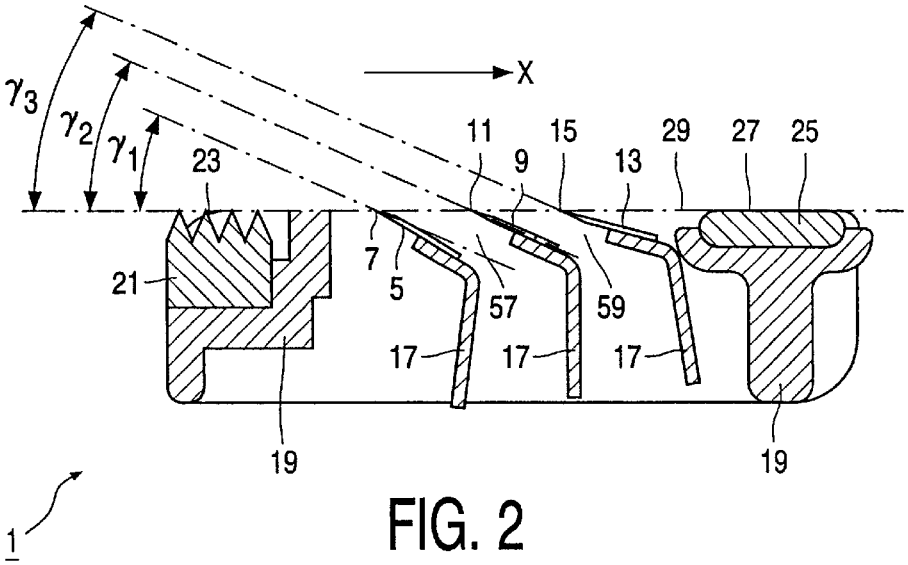
FIG. 2 is a diagrammatic sectional view of the first embodiment of the shaving head in accordance with the invention, taken on the line 11—11 in FIG. 1.

As shown in FIG. 1 and FIG. 2, the shaving head 1 comprises a first cutting member 5 which is provided with a substantially straight cutting edge 7 which extends perpendicularly to a shaving direction X of the shaving head 1, a second cutting member 9 which, viewed in the shaving direction X, is arranged behind the first cutting member 5 and provided with a substantially straight cutting edge 11 which also extends perpendicularly to the shaving direction X, and a third cutting member 13 which, viewed in the shaving direction X, is arranged behind the second cutting member 9 and provided with a substantially straight cutting edge 15 which also extends perpendicularly to the shaving direction X. The cutting members 5, 9, 13 are each secured onto a securing element 17, shown in FIG. 2, which is attached to a holder 19 of the shaving head 1. It is to be noted that the shaving direction X is to be taken to mean a direction in which the skin to be shaved moves, in operation, with respect to the shaving head 1. Consequently, the shaving direction X is opposed to a displacement direction X', shown in FIG. 1, in which the shaving head 1 is to be moved, in operation, over the skin to be shaved. Viewed in the shaving direction X, a first skin-supporting element 21 is provided on the holder 19 in front of the first cutting member 5, which skin-supporting element also has a skin-tightening function and is provided with a skin-supporting surface 23. Furthermore, a second skin-supporting element 25 provided with a skin-supporting surface 27 is provided on the holder 19 behind the third cutting member 13, viewed in the shaving direction X. The two skin-supporting surfaces 23, 27 define, in the example shown, a skin contact surface 29 with which the shaving head 1, in operation, bears against the skin to be shaved and in which also the cutting edges 7, 11, 15 of the cutting members 5, 9, 13 extend.

Figure 3:
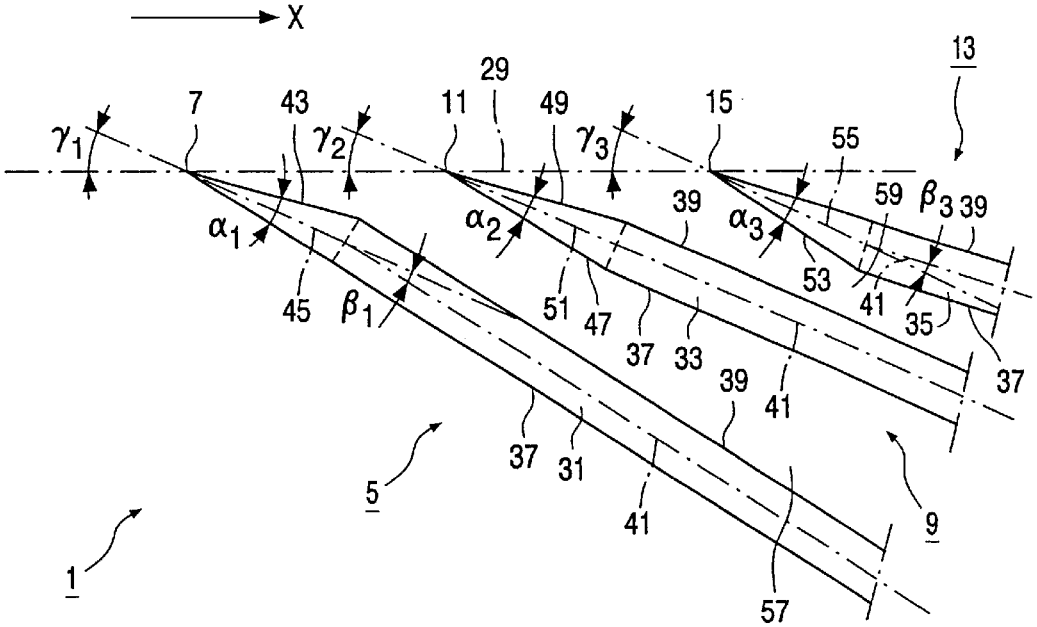
FIG. 3 shows in detail how three cutting members of the shaving head shown in FIG. 2 are arranged relative to each other.

As shown in detail in FIG. 3, the cutting members 5, 9, 13 each comprise a plate-shaped steel carrier 31, 33, 35 on which the relevant cutting edge 7, 11, 15 is provided. The carriers 31, 33, 35 each comprise two mutually parallel main side faces 37, 39 between which an imaginary center plane 41 extends. The cutting edge 7 of the first cutting member 5 has a tip angle $\alpha_1$, which is substantially enclosed by the main side face of the carrier 31, which main side face faces away from the second cutting member 9, and by a facet surface 43 provided on the main side face 39 of the carrier 31, which main side face faces the second cutting member 9. The cutting edge 7 is thus situated on a side, facing away from the second cutting member 9, of the center plane 41 of the carrier 31. By virtue thereof, the tip angle $\alpha_1$ is asymmetrical relative to the center plane 41 of the carrier 31, and the bisector 45 of the tip angle $\alpha_1$ and the center plane 41 of the carrier 31 enclose an angle $\beta_1=\alpha_3/2$. The cutting edge 11 of the second cutting member 9 has a tip angle $\alpha_2$, which is substantially equal to the tip angle $\alpha_1$ and which is enclosed by two facet surfaces 47, 49, which are symmetrical relative to the imaginary center plane 41 of the carrier 33, which facet surfaces are provided on the respective main side faces 37, 39 of the carrier 33. The cutting edge 11 is thus situated substantially in the center plane 41 of the carrier 33. As a result, the tip angle $\alpha_2$ is substantially symmetrical relative to the center plane 41 of the carrier 33, and the bisector 51 of the tip angle $\alpha_2$ is situated substantially in the center plane 41 of the carrier 33. The cutting edge 15 of the third cutting member 13 has a tip angle $\alpha_3$ which is also substantially equal to the tip angle $\alpha_1$ and is predominantly enclosed by the main side face 39 of the carrier 35, which main side face faces away from the second cutting member 9, and by a facet surface 53 provided on the main side face 37 of the carrier 35, which main side face faces the second cutting member 9. The cutting edge 15 is thus situated on a side of the center plane 41 of the carrier 35, which faces away from the second cutting member 9. As a result, the tip angle $\alpha_3$ is asymmetrical relative to the center plane 41 of the carrier 35, and the bisector 55 of the tip angle $\alpha_3$ and the center plane 41 of the carrier 35 enclose an angle $\beta_3=\alpha_3/2$. As is further shown in FIG. 3, a cutting angle $\gamma_1$, $\gamma_2$, $\gamma_3$, present between the cutting members 5, 9, 13 and the skin contact surface 29, according to which cutting angle the cutting members 5, 9, 13 cut hairs present on the skin to be shaved, is defined as the acute angle between the skin contact surface 29 and the bisector 45, 51, 55 of the tip angle $\alpha_1$, $\alpha_2$, $\alpha_3$. In the first embodiment of the shaving head in accordance with the invention, as shown in FIG. 2 and FIG. 3, the cutting angles $\gamma_1$, $\gamma_2$, $\gamma_3$ of the three cutting members 5, 9, 13 are substantially equal to each other. In the example shown, the cutting angles $\gamma_1$, $\gamma_2$, $\gamma_3$ are approximately 23°, while the tip angles $\alpha_1$, $\alpha_2$, $\alpha_3$ are approximately 16°. Furthermore, the thickness of the carriers 31, 33, 35 is approximately 0.8 mm, so that the facet surfaces 43, 47, 49, 53 have a length of approximately 3 mm. As the bisector 45 of the tip angle $\alpha_1$ of the first cutting member 5 and the center plane 41 of the carrier 31 enclose the angle $\beta_1$, and the cutting edge 7 of the first cutting member 5 is situated on the side of the center plane 41 of the carrier 31 that faces away from the second cutting member 9, an interspace 57 is present, as shown in FIG. 3, between the carrier 31 of the first cutting member 5 and the carrier 33 of the second cutting member 9, which interspace diverges, viewed from the skin contact surface 29. As the bisector 55 of the tip angle $\alpha_3$ of the third cutting member 13 and the center plane 41 of the carrier 35 enclose the angle $\beta_3$, and the cutting edge 15 of the third cutting member 13 is situated on the side of the center plane 41 of the carrier 35 that faces away from the second cutting member 9, an interspace 59 is present, as shown in FIG. 3, between the carrier 35 of the third cutting member 13 and the carrier 33 of the second cutting member 9, which interspace is also divergent, viewed from the skin contact surface 29. The divergent interspaces 57, 59 have a divergence angle which is substantially equal to, respectively, the angle $\beta_1$ and the angle $\beta_3$, which in the example shown are both approximately 8°. As, viewed from the skin contact surface 29, the interspaces 57, 59 are both divergent, hairs and shaving foam cut and removed, respectively, from the skin at an earlier point in time and collected in the interspaces 57, 59 are removed relatively easily from the interspaces 57, 59 in a direction facing away from the skin contact surface 29 by hairs and shaving foam cut off and removed, respectively, from the skin at a later point in time. As a result, the risk of the interspaces 57, 59 becoming clogged by cut hairs and shaving foam removed from the skin is small. The shaving performance of the shaving head 1 would be adversely affected if the interspaces 57, 59 became clogged in the manner described above.

Figure 4:
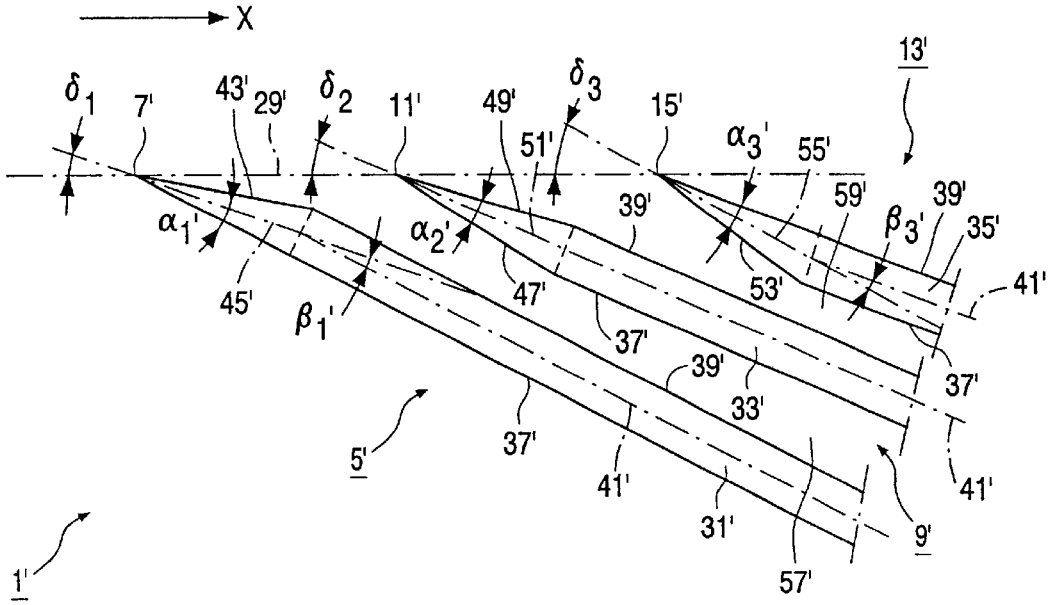
FIG. 4 shows in detail how three cutting members of a second embodiment of a shaving head in accordance with the invention are arranged relative to each other.

FIG. 4 shows three cutting members 5', 9', 13' of a second embodiment of a shaving head 1' in accordance with the invention, which can suitably be used in a shaver in accordance with the invention. Components of the shaving head 1' corresponding to components of the above-described shaving head 1 are indicated, in FIG. 4, by means of corresponding reference numerals. Hereinbelow, only the differences between the shaving head 1' and the shaving head 1 are discussed. The main difference between the shaving head 1' and the shaving head 1 resides in that a cutting angle $\delta_2$ present between the second cutting member 9' and the skin contacting surface 29' is larger than a cutting angle $\delta_1$ present between the first cutting member 5' and the skin contacting surface 29', and in that a cutting angle $\delta_3$ present between the third cutting member 13' and the skin contacting surface 29' is larger than said cutting angle $\delta_2$. In the example shown, $\delta_1$ is approximately 18°, $\delta_2$ is approximately 23° and $\delta_3$ is approximately 28°. It has been found that the skin smoothness that can be achieved using a cutting member of a type like the cutting members 5', 9', 13' is higher as the cutting angle of the cutting member is larger. However, as the cutting angle increases, the shaving comfort decreases because the tensile forces exerted by the cutting member on the hairs upon cutting said hairs increase. It has been found, however, that the cutting of comparatively short hairs by means of such a cutting member having a large cutting angle is experienced as much less painful by the user than the cutting of comparatively long hairs by means of such a cutting member. In the case of the shaving head 1', the hairs are first cut by the first cutting member 5' having the comparatively small cutting angle $\delta_1$. As the cutting angle $\delta_1$ is comparatively small, the first cutting member 5' exerts only small tensile forces on the hairs. As the cutting angle $\delta_2$ is larger than the cutting angle $\delta_1$, the hairs already shortened by the first cutting member 5' are subsequently shortened further by the second cutting member 9'. As the hairs shortened by the first cutting member 5' are comparatively short, the action of the second cutting member 9' involves comparatively little discomfort. Finally, the hairs shortened by the first cutting member 5' and the second cutting member 9' are further shortened by the third cutting member 13', as a result of which a comparatively high skin smoothness is achieved, which is characteristic of a cutting member having a comparatively large cutting angle, such as the third cutting member 13'. As the hairs shortened by the first cutting member 5' and the second cutting member 9' are very short already, also the action of the third cutting member 13' involves comparatively little discomfort. In this manner, the increasing values of the cutting angles $\delta_1$, $\delta_2$, and $\delta_3$ in the shaving direction X provide a comparatively high skin smoothness, while also the shaving comfort is comparatively high in spite of the comparatively large cutting angle $\delta_3$. As, viewed in the shaving direction X, the values of the cutting angles $\delta_1$, $\delta_2$ and $\delta_3$ increase, the interspace 57' between the carriers 31' and 33', and the interspace 59' between the carriers 33' and 35' would be convergent, viewed from the skin contact surface 29', if the cutting edges 7' and 15' of the cutting members 5' and 13' as well as the cutting edge 11' of the cutting member 9' were situated in the relevant imaginary center plane 41', in which case the interspaces 57' and 59' would have a convergence angle of approximately 5°, which is equal to the difference between the cutting angles $\delta_2$ and $\delta_1$, and the difference between the cutting angles $\delta_3$ and $\delta_2$. The risk of such convergent interspaces becoming clogged by cut hairs and shaving foam is substantial. As, in the case of the shaving head 1', the angle $\beta_1'$ is present between the bisector 45' of the tip angle $\alpha_1'$ and the center plane 41' of the carrier 31', which angle $\beta_1'$ is approximately 8° in the example shown, and as the cutting edge 7' of the first cutting member 5' is situated on the side, facing away from the second cutting member 9', of the center plane 41' of the carrier 31', the interspace 57', viewed from the skin contact surface 29', is divergent, however, having a small divergence angle of approximately 3°, which is equal to $\beta_1'-(\delta_2-\delta_1)$. For comparable reasons, the interspace 59', viewed from the skin contact surface 29', is divergent having a small divergence angle of approximately 3°, which is equal to $\beta_3'-(\delta_3-\delta_2)$. In this manner, the risk of the interspaces 57' and 59' becoming clogged by cut hairs and shaving foam is substantially reduced also in the case of the shaving head 1'.

Figure 5:
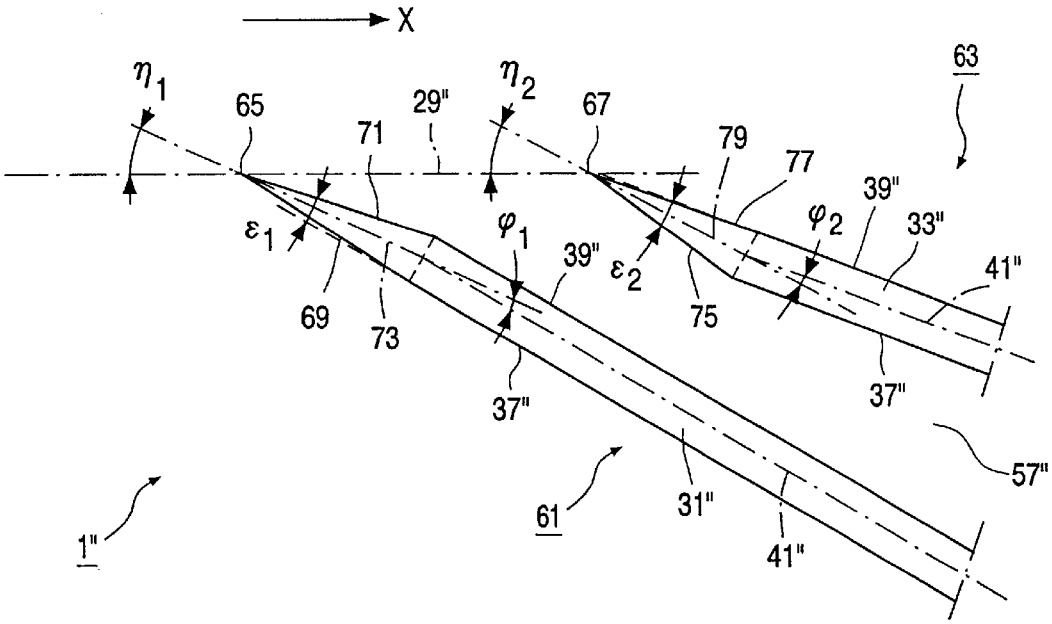
FIG. 5 shows in detail how two cutting members of a third embodiment of a shaving head in accordance with the invention are arranged relative to each other.

FIG. 5 shows two cutting members 61 and 63 of a third embodiment of a shaving head 1" in accordance with the invention, which can suitably be used in a shaver in accordance with the invention. Parts of the shaving head 1" corresponding to parts of the above-described shaving head 1 are indicated, in FIG. 5, by means of corresponding reference numerals. Hereinbelow, only differences between the shaving head 1" and the shaving head 1 are discussed. The main difference between the shaving head 1" and the shaving head 1 resides in that the shaving head 1" comprises only a first cutting member 61 and a second cutting member 63 which is arranged, viewed in the shaving direction X, behind the first cutting member 61. The first cutting member 61 has a cutting edge 65, while the second cutting member 63 has a cutting edge 67. In the example shown, the cutting edge 65 of the first cutting member 61 has a tip angle $\epsilon_1$ which is enclosed by a first facet surface 69 provided on the main side face 37", facing away from the second cutting member 63, of the carrier 31", and by a second facet surface 71 provided on the main side face 39", facing the second cutting member 63, of the carrier 31". As shown in FIG. 5, an obtuse angle enclosed by the first facet surface 69 and the main side face 37" is larger than an obtuse angle enclosed by the second facet surface 71 and the main side face 39". As a result, the cutting edge 65 is situated on a side, facing away from the cutting member 63, of the center plane 41" of the carrier 31", so that the tip angle $\epsilon_1$ is asymmetrical with respect to the center plane 41" of the carrier 31", and the bisector 73 of the tip angle $\epsilon_1$ and the center plane 41" of the carrier 31" enclose an angle $\phi_1$. The cutting edge 67 of the second cutting member 63 has a tip angle $\epsilon_2$ which is enclosed by a first facet surface 75 provided on the main side face 37", facing the first cutting member 61, of the carrier 33" and by a second facet surface 77 provided on the main side face 39", facing away from the first cutting member 61, of the carrier 33". An obtuse angle enclosed by the first facet surface 75 and the main side face 37" is smaller than an obtuse angle enclosed by the second facet surface 77 and the main side face 39". As a result, the cutting edge 67 is situated on a side, facing away from the first cutting member 61, of the center plane 41" of the carrier 33", so that the tip angle $\epsilon_2$ is asymmetrical with respect to the center plane 41" of the carrier 33", and the bisector 79 of the tip angle $\epsilon_2$ and the center plane 41" of the carrier 33' enclose an angle $\phi_2$. In the example shown, the tip angle $\epsilon_1$ and $\epsilon_2$ are both approximately 16°, while the angles $\phi_1$ and $\phi_2$ are both approximately 6.5°. As shown in FIG. 5, a cutting angle $\eta_1$ is present between the first cutting member 61 and the skin contact surface 29", which cutting angle is defined as the acute angle between the skin contact surface 29" and the bisector 73, while a cutting angle $\eta_2$ is present between the second cutting member 63 and the skin contact surface 29", which cutting angle is defined as the acute angle between the skin contact surface 29" and the bisector 79. In the example shown, the cutting angle $\eta_1$ is approximately 20°, while the cutting angle $\eta_2$ is approximately 25°. As the values of the cutting angles $\eta_1$, $\eta_2$ increase, viewed in the direction of shaving X, the skin smoothness that can be achieved using the shaving head 1" is, in common with that of the shaving head 1', comparatively high, while the shaving comfort of the shaving head 1" is, in common with that of the shaving head 1', also comparatively high in spite of the comparatively large value of the cutting angle $\eta_2$. As the values of the cutting angles $\eta_1$, $\eta_2$ increase, viewed in the shaving direction X, the space 57" between the carriers 31" and 33", viewed from the skin contact surface 29", would be convergent if the cutting edges 65 and 67 of the cutting members 61 and 63 were situated in the imaginary center plane 41" of the relevant carrier 31", 33", in which case a convergence angle of the interspace 57" would be approximately 5°, which is equal to the difference between the cutting angles $\eta_2$ and $\eta_1$. The risk of such a convergent interspace becoming clogged by cut hairs and shaving foam is considerable. As said angles $\phi_1$, $\phi_2$ are present between the bisectors 73, 79 of the tip angles $\epsilon_1$, $\epsilon_2$ and the center planes 41" of the carriers 31", 33", and as the cutting edge 65 of the first cutting member 61 is situated on the side, facing away from the second cutting member 63, of the center plane 41" of the carrier 31", while the cutting edge 67 of the second cutting member 63 is situated on the side, facing away from the first cutting member 61, of the center plane 41" of the carrier 33", the interspace 57", however, viewed from the skin contact surface 29', is divergent having a divergence angle of approximately 8°, which is equal to $(\phi_1+\phi_2-(\eta_2-\eta m_1)$. In this manner, the risk of the interspace 57" becoming clogged by cut hairs and shaving foam is also reduced substantially in the case of the shaving head 1".

As the tip angles $\alpha_1$, $\alpha_3$, $\alpha_1'$, $\alpha_3'$ of the cutting members 5, 13, 5', 13' of the above-mentioned shaving heads 1 and 1' are each enclosed by only one facet surface 43, 53, 43', 53' and by one of the main side faces 37, 39, 37', 39' of the carrier 31, 35, 31', 35' of the relevant cutting member 5, 13, 5', 13', i.e. the tip angles are chisel-shaped, said tip angles $\alpha_1$, $\alpha_3$, $\alpha_1'$, $\alpha_3'$ themselves are more responsible for the divergence of the interspace between the cutting members than the tip angles $\epsilon_1$, $\epsilon_2$ of the cutting members 61, 63 of the shaving head 1", which are each enclosed by two facet surfaces 69, 71 and 75, 77. It is to be noted, however, that a two-sided sharpening process, by means of which the tip angle $\epsilon_1$, $\epsilon_2$ can be formed, is much simpler than a single-sided sharpening process by means of which the tip angles $\alpha_1$, $\alpha_3$, $\alpha_1'$, $\alpha_3'$ can be provided. It is further to be noted that the development of a comparatively small facet surface on the non-sharpened main side face 37, 39, 37', 39' of the relevant carrier 31, 35, 31', 35' near the cutting edge substantially cannot be precluded when use is made of a single-sided sharpening process. For this reason, the expression "substantially enclosed by" is used in the claims to describe the tip angles $\alpha_1$, $\alpha_3$, $\alpha_1'$, $\alpha_3'$. It is further to be noted that the invention also comprises embodiments wherein the cutting edge of at least one of the two cutting members is situated on a side, facing away from the other cutting member, of an imaginary plane in which the main side face, facing away from the other cutting member, of the carrier of the relevant cutting member is situated. In such an embodiment, the tip angle of the relevant cutting edge is more asymmetrical relative to the imaginary center plane of the carrier than the above-mentioned tip angles $\alpha_1$, $\alpha_3$, $\alpha_1''$, $\alpha_3'$, so that, in such an embodiment, the asymmetric tip angle itself contributes even more substantially to the development of a divergent interspace between the cutting members. The provision of such a cutting edge is much more difficult, however, than the provision of a chisel-shaped cutting edge by means of single-sided sharpening.

It is to be noted that the invention comprises embodiments wherein the cutting members have equal cutting angles relative to the skin contacting surface, as in the case of the above-described shaving head 1, as well as embodiments wherein the cutting members, viewed in the shaving direction, have cutting angles that increase in size, as in the case of the above-described shaving heads 1'and 1". In an embodiment with equal cutting angles, the invention always leads to a divergent interspace between the cutting members. In the above-described embodiments wherein the size of the cutting angles increases, viewed in the shaving direction, the invention also leads to divergent interspaces between the cutting members. It is to be noted, however, that the invention also comprises embodiments wherein, the cutting members, viewed in the shaving direction, have cutting angles that increase in size, but wherein the invention only leads to a less convergent interspace between the cutting members. In such embodiments, for example, the difference between the cutting angles of the cutting members is so large, and hence the interspace is so strongly convergent, that the asymmetry of the tip angles of the cutting members only leads to a less convergent interspace. The risk that such a less convergent interspace becomes clogged is much smaller, however, than the risk that a more convergent interspace becomes clogged.

The invention comprises embodiments wherein only one cutting member of two juxtaposed cutting members is provided with an asymmetrical tip angle, as in the case of the above-discussed shaving heads 1 and 1', and embodiments wherein the two juxtaposed cutting members have an asymmetrical tip angle. The invention thus also comprises, for example, an embodiment having only two cutting members of which only one cutting member has an asymmetrical tip angle.

Finally, it is to be noted that the invention can also be applied in types of shavers other than the shaver in accordance with the invention described hereinabove, said shaver in accordance with the invention being embodied so as to be a razor without electrical function. An example of such another type of shaver is, for example, a shaver which, apart from at least two cutting members which each have a substantially straight cutting edge, is provided, viewed in the shaving direction, with a hair manipulator arranged in front of the first cutting member, which hair manipulator is embodied, for example, so as to be a comb that can be reciprocated by means of an electric motor in a direction parallel to the cutting edge of the first cutting member. In such a shaver, the hairs are reciprocated along the cutting edge by the hair manipulator during the cutting process, as a result of which, viewed in the shaving direction, a substantial reduction of the necessary cutting forces is achieved.

What is claimed is:

1. A shaving head comprising at least a first cutting member and a second cutting member which, viewed in a shaving direction of the shaving head, is arranged behind and spaced apart from the first cutting member to create an interspace between the first and second cutting members, said cutting members each comprising a plate-shaped carrier having mutually parallel first and second main side faces, the first main side face of the first cutting member facing away from the second cutting member and the second main side face of the first cutting member facing the second cutting member, the first and second cutting members provided with a substantially straight cutting edge extending substantially in a skin contact surface with which, in operation, the shaving head bears against the skin to be shaved, and a cutting angle present between the second cutting member and the skin contact surface being equal to or larger than a cutting angle present between the first cutting member and the skin contact surface, the cutting edge of at least the first cutting member being situated on a side, facing away from the second cutting member, of an imaginary center plane of the carrier of the first cutting member, said imaginary center plane extending between the first and second main side faces of the carrier, characterized in that the interspace between the first and second cutting members, as viewed from the skin contact surface, is divergent.

2. A shaving head as claimed in claim 1, characterized in that the cutting edge of the first cutting member has a tip angle which is predominantly enclosed by the first main side face and by a facet surface provided on the second main side face.

3. A shaving head as claimed in claim 1, characterized in that the shaving head is provided with only two cutting members, the cutting edge of the first cutting member being situated on a side, facing away from the second cutting member, of the imaginary center plane of the carrier of the first cutting member, while the cutting edge of the second cutting member is situated on a side, facing away from the first cutting member, of the imaginary center plane of the carrier of the second cutting member.

4. A shaving head as claimed in claim 1, characterized in that the shaving head is provided with a third cutting member which, viewed in the shaving direction, is arranged behind the first and the second cutting member, the third cutting member comprising a carrier having a cutting edge, a cutting angle present between the third cutting member and the skin contact surface being equal to or larger than a cutting angle present between the second cutting member and the skin contact surface, and the cutting edge of the second cutting member being situated substantially in the imaginary center plane of the carrier of the second cutting member, the cutting edge of the first cutting member, however, being situated on a side, facing away from the second cutting member, of the imaginary center plane of the carrier of the first cutting member, and the cutting edge of the third cutting member being situated on a side, facing away from the second cutting member, of the imaginary center plane of the carrier of the third cutting member.

5. A shaver comprising a handgrip and a shaving head secured to said handgrip, which shaving head is a shaving head as claimed in claim 1.

* * * * *